US006659195B2

(12) United States Patent
Schmon

(10) Patent No.: US 6,659,195 B2
(45) Date of Patent: Dec. 9, 2003

(54) EXTERNALLY VENTED DRIVE HEAD WITH SOLID CENTER

(76) Inventor: Robert J. Schmon, 150B Hazelton Rd., Gates, NC (US) 27937

( * ) Notice: Subject to any disclaimer, the term of this patent is extended or adjusted under 35 U.S.C. 154(b) by 0 days.

(21) Appl. No.: 10/010,473

(22) Filed: Dec. 10, 2001

(65) Prior Publication Data

US 2003/0106716 A1 Jun. 12, 2003

(51) Int. Cl.[7] ..... E21B 7/26; E21B 27/00
(52) U.S. Cl. ..... 175/20; 175/244
(58) Field of Search ..... 175/20, 58, 244, 175/320, 308

(56) References Cited

U.S. PATENT DOCUMENTS 3,047,081 A * 7/1962 Pitcher ..... 175/239
3,180,438 A * 4/1965 Dickinson et al. ..... 175/239
3,515,230 A * 6/1970 Tomaine ..... 175/242
3,878,906 A * 4/1975 Guest ..... 175/405
5,411,087 A * 5/1995 Taylor ..... 166/264
5,419,211 A * 5/1995 Rodel et al. ..... 73/864.45
5,606,139 A * 2/1997 Wittig et al. ..... 73/864.44
5,743,343 A * 4/1998 Heller et al. ..... 175/20
6,047,782 A * 4/2000 Ballard et al. ..... 175/20

* cited by examiner

*Primary Examiner*—David Bagnell
*Assistant Examiner*—Jennifer H Gay
(74) *Attorney, Agent, or Firm*—E. Strickland

(57) ABSTRACT

A drive head for supporting a soil sampling tube in a drive assembly in which the head and tube are driven into the ground by a power source connected to the head or to at least one drive rod connected to the head. The drive head has a body portion in the configuration of a truncated cone, which is provided with an integral upper threaded nipple for attaching to the drive rod, and an integral lower threaded nipple for attaching to the sampling tube. The drive head has, in addition, a solid body provided with a venting passageway that extends from the lower threaded nipple to an outer surface of the truncated cone for venting air from the head and tube when the head and tube are driven into the ground.

3 Claims, 2 Drawing Sheets

EXTERNALLY VENTED DRIVE HEAD WITH SOLID CENTER

FIELD OF THE INVENTION

The present invention relates generally to soil sampling apparatus, and more particularly to a solid head means that prevents soil from entering hollow drive rods attached to the head means.

BACKGROUND OF THE INVENTION

Geological sampling apparatus for surveying ground soil are well known. Such apparatus usually includes a sampling probe fastened to the lower end of a first drive rod while successive drive rods are serially connected to the first rod to provide a vertical distance appropriate for the level in the ground and earth at which a soil sample is sought. The probe and serially connected rods are directly driven into the ground by a suitable power source such as a hydraulic cylinder. The rods are made of a high strength durable steel.

"Direct push" soil sampling apparatus presently uses an elongated sampling tube connected to the first, lower most hollow rod by an open center head, i.e., the head has a lower nipple section or portion that attaches to the elongated sampling tube while an upper nipple portion of the head is mechanically connected to the lower end of the lowermost hollow drive rod or directly to the driving power source. When the drive rods and power source thrust the sampling tube into the ground the tube can fill with loose soil or wet mud and water as air in the tube is expelled through the open center head and up through the hollow rods. As the driving process continues, loose, wet soil travels up through the open center head and hollow rods where the soil compacts in the rods.

The sampling tube and connecting head are also made of a high strength durable steel as is a lower soil penetrating shoe discussed hereinafter.

Direct push soil sampling apparatus employs a hydraulic cylinder to directly drive (hammer) connecting drive rods, sampling tube, and head into the ground. U.S. Pat. No. 5,606,139 to Kejr is an example of the direct push or drive apparatus. The hollow connecting rods of the apparatus are used to receive internal tooling. One set of such tooling includes serially connected rods (not shown) inserted into and through the hollow rods to a lower pointed plug (not shown) moved into place in a cutting shoe connected to the lower end of the sampling tube by actuation of the solid rods for the purpose of keeping soil from entering the sampling tube during its downward thrust into the ground to the depth and location of sampling.

Another set of tooling involves the insertion of small diameter tubing into the hollow rods for the purpose of pumping water from the bore hole created by the sampling assembly when driven into the ground.

When the connecting rods are compacted internally with soil the tooling obviously cannot be used until the soil is removed, and the process of removing the compacted soil can be extremely difficult. Hammering and beating on the hollow rods is often the method used to remove the soil.

BRIEF SUMMARY OF THE INVENTION

The present invention uses a drive head having a solid body that prevents any travel of mud and soil into the hollow drive rods. Rather, air is vented and expelled from the head when it enters the ground by at least one passageway that extends from a lower portion of the head to an upper sloping surface of the head, the head having a body portion in the configuration of a truncated cone. The cone has a narrow upper end provided with a threaded nipple for attaching to a hollow drive rod while the lower, broader end of the cone has a threaded nipple for connecting to and supporting the soil sampling tube. As the tube and head are driven into the ground a vertical bore hole is created in the ground and earth while loose soil or mud enters the tube as air is vented into the bore hole. The air travels upwardly through the bore hole to the atmosphere above ground. When the above internal tooling is required; the solid head of the invention is removed from the sampling apparatus and replaced by the prior hollow head.

BRIEF DESCRIPTION OF THE DRAWINGS

The invention, along with its advantages and objectives, will be best understood from consideration of the following detailed description and the accompanying drawings in which.

DETAILED DESCRIPTION OF THE INVENTION

Figure 1:
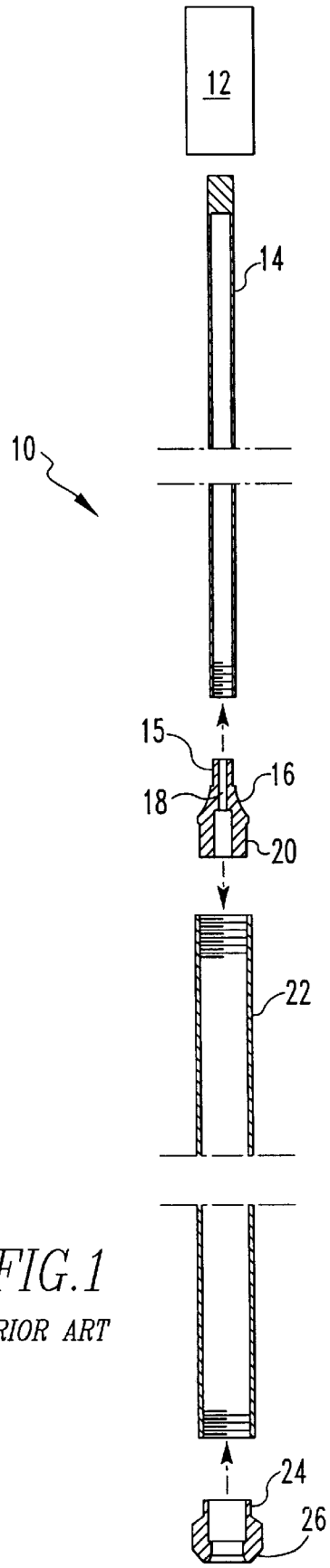
FIG.1 PRIOR ART
FIG. 1 is an exploded, somewhat schematic presentation of a prior art direct push soil sampling assembly and apparatus in which a hydraulic cylinder is mechanically connected to serially connected rods, the lowermost rod of the apparatus mechanically connected to head means which, in turn, supports a soil sampling tube.

Referring now to FIG. 1 of the drawings, a direct push soil sampling system and apparatus is shown in exploded form and is labeled by reference numeral 10. More particularly, assembly 10 comprises a hydraulic cylinder 12 (only diagrammatically shown) mechanically connected to a first hollow drive or push rod 14, though the hydraulic cylinder can initially be connected directly to a drive head 16 and a sampling tube 22 for initially driving the tube into the ground. After the sampling tube is driven into the ground, drive rods 14 can be added as needed.

Push or drive rod 14 represents a plurality of such rods and is broken away diagrammatically in its longitudinal center in FIG. 1 to reduce the size of the figure so that it can be confined to one sheet of drawing. Such rods 14 themselves can be of unspecified length but are usually three to four (or more) feet long, with the ends thereof threaded for connecting to each other in a serial manner.

The lower end of the lowermost hollow rod 14 is internally threaded (not visible in FIG. 1) to thread onto an upper externally threaded integral nipple 15 of a prior art, open center drive head 16. Head 16 includes, in addition a lower externally threaded nipple 20 for threadably connection to an internally threaded upper end of an elongated soil sampling tube 22.

The interior of the head including its threaded nipples are open throughout the length of the head and nipples as indicated by numeral 18 in FIG. 1.

Like the drive or push rods of 14, sampling tube 22 can be three to four feet long so that in FIG. 1 the tube is also broken away diagrammatically to fit assembly 10 on a single sheet of drawing.

The lower end of sampling tube 22 is shown provided with internal threads for threading to a cutting shoe 24 having a beveled, sharp end 26 for penetrating the ground when the rods, head, tube, and shoe are driven downwardly by hydraulic cylinder 12. Cylinder 12 is usually a hydraulic jack hammer that provides downwardly driving pulsating thrusts to rods 14.

When cutting shoe 24 and sampling tube 22 are driven into the ground and earth by cylinder 12 soil enters the tube so that air in the tube and in head 16 is vented upwardly through the tube and head (via opening 18 in the head) and through hollow rods 14 (when added) to atmosphere. As the driving process continues, soil can enter opening 18 in hollow head 16 and travel through the head to and into rods 14. For the reasons given above, any soil in the rods must be removed, and removal can be a tedious and laborious process.

Figure 2:
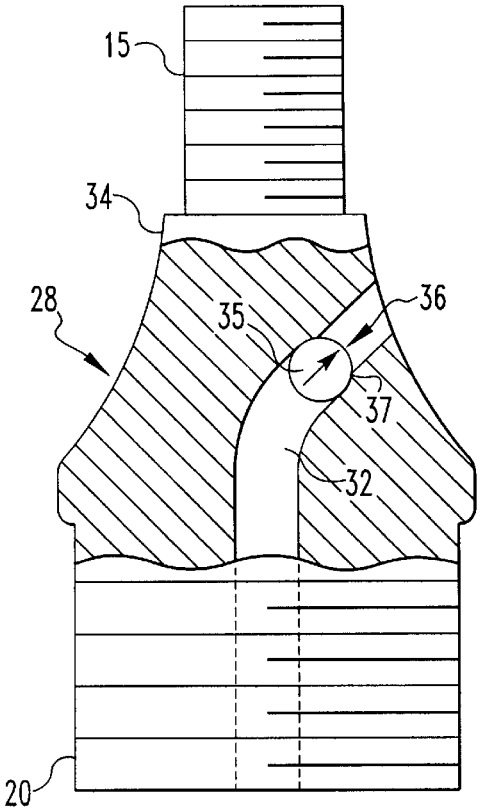
FIG. 2 is an elevation view of a solid head structure of the present invention showing, inter alia, a truncated cone portion of the head and a venting passageway (in phantom) extending to one side of the cone.
Figure 3:
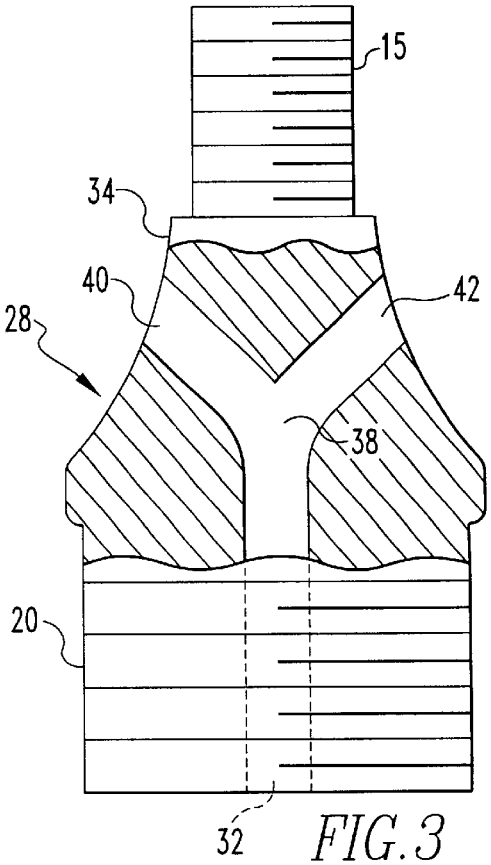
FIG. 3 is an elevation view of a second embodiment of the head of the invention in which the venting passageway is bifurcated to provide two venting avenues to an upper outside surface of the head.

The present invention replaces open center head 16 with a solid head 28, as shown in FIGS. 2 and 3 of the drawings, having a solid body 30 so that no soil, mud, or water can enter hollow tubes 14. A passageway 32 is provided in the solid body of the head in FIG. 2 permit venting of the air in sampling tube 22 and in head 28 to the bore hole (not shown) created in the earth when shoe 24, and 22, and head 28 are driven into the earth. From such bore hole, air is vented to atmosphere. The bore hole above head 16 is the width of the widest portion of the head so that there is ample room above the head and around rods 14 for the venting of air in tube 22 and head 28. A typical diameter of sampling tube 22, shoe 24, and the lower nipple end 20 of the head is about two inches, whereas the diameter of rods 14 is on order of one inch.

The lower nipple end of head 28 transitions upwardly to the upper nipple 15 such that an intermediate body portion 34 of the head is that of truncated cone, with the narrow end of the cone being at the nipple end 15 while the broader end of the cone is at the lower end of the head adjacent nipple 20 when the head is in the vertical position shown in drawing FIGS. 2 and 3.

Passageway 32 can be provided in the solid body of head 28 by a number of manufacturing methods including forging, machining or drilling.

FIG. 2 of the drawings shows, in addition, a check valve 36 located in passageway 32, the purpose of which is to prevent removal of the soil sample (not shown) in tube 22 from being drawn out of the tube and through head 28 when apparatus 10 is pulled from the earth after the sample is taken, i.e, as tube 22 and head 28 are pulled from the bore hole created in the ground, reduced air pressure occurs that can ordinarily suck at least a portion of the soil sample from the tube. Valve 36 is kept open during the driving process by air passing between a ball 35 and its seat 37 (FIG. 2) which keeps the ball from its seat so that the air in tube 22 can escape. The sucking action during removal of the sampling apparatus from the bore hole drives the ball against its seat to prevent removal of the soil sample from the tube.

After the apparatus of 10 is removed from the ground, sample tube 22 is unthreaded from head 28 so that the soil sample can be removed from the tube for analysis.

FIG. 3 of the drawings shows an embodiment of the invention in which venting passageway 32 is divided or bifurcated at 38 in head 28 to provide more than one passageway that extends to at least two ports 40 and 42 on the surface of intermediate cone 34. Like the single passageway 32, the divisions or bifurcations of the passageway can be provided when the head is machined, or by drilling.

While the invention has been described in terms of preferred embodiments, the claims appended hereto are intended to encompass all embodiments that fall within the spirit and scope of the invention.

What is claimed is:

1. A drive head for supporting a soil sampling tube in a drive assembly in which head and tube are driven into the ground by a power source connected to the head or to at least one hollow drive rod connected to the head, said drive head having a body portion in the configuration of a truncated cone, said cone being provided with an integral upper threaded nipple for attaching to said drive rod, and an integral lower threaded nipple for attaching to said sampling tube, said drive head having, in addition, a solid body that prevents air and solids from entering the hollow rod, said head having a venting passageway that extends from the lower threaded nipple to an outer surface of the truncated cone for venting air, liquids and or solids from the head and tube and into a bore hole space created above the truncated cone of the head when the head and tube are driven into the ground, said truncated cone providing a space within any bore hole created by the head and sampling tube when driven into the ground.

2. The drive head of claim 1 wherein the venting passageway in the solid body of said drive head is bifurcated to provide two passageways that extend to two venting locations on the surface of the truncated cone.

3. The drive head of claim 1 wherein the passageway is divided to provide more than one venting location on the surface of the truncated cone.

* * * * *